US009273465B1

(12) United States Patent
Bergman et al.

(10) Patent No.: US 9,273,465 B1
(45) Date of Patent: Mar. 1, 2016

(54) CEILING SYSTEM

(71) Applicant: ARMSTRONG WORLD INDUSTRIES, INC., Lancaster, PA (US)

(72) Inventors: Todd M. Bergman, Lititz, PA (US); G. Douglas Vernau, Mountville, PA (US); Ryan D. Hanuschak, Lancaster, PA (US)

(73) Assignee: AWI Licensing Company, Wilmington, DE (US)

( * ) Notice: Subject to any disclaimer, the term of this patent is extended or adjusted under 35 U.S.C. 154(b) by 0 days.

(21) Appl. No.: 14/500,249

(22) Filed: Sep. 29, 2014

(51) Int. Cl.

| | |
|---|---|
| ***E04B 9/06*** | (2006.01) |
| ***E04B 9/22*** | (2006.01) |
| ***E04B 9/04*** | (2006.01) |
| ***E04F 13/076*** | (2006.01) |
| ***E04F 13/08*** | (2006.01) |

(52) U.S. Cl.
CPC . *E04B 9/225* (2013.01); *E04B 9/04* (2013.01); *E04B 9/0435* (2013.01); *E04B 9/06* (2013.01); *E04F 13/076* (2013.01); *E04F 13/0862* (2013.01)

(58) Field of Classification Search
CPC ..... E04B 9/225; E04B 9/06; E04B 13/076; E04B 13/0862; E04B 9/04; E04B 9/28; E04B 9/30; E04B 9/34; E04B 9/14; E04B 9/122; E04B 9/16; E04B 9/0435
USPC ..... 52/506.09, 506.1, 506.08, 506.07, 52/506.06
See application file for complete search history.

(56) References Cited

U.S. PATENT DOCUMENTS

| | | | | |
|---|---|---|---|---|
| 3,332,194 | A * | 7/1967 | Jack | 52/591.1 |
| 3,360,896 | A * | 1/1968 | Wright | 52/506.09 |
| 3,488,908 | A * | 1/1970 | Jahn | 52/778 |
| 3,900,997 | A * | 8/1975 | Ollinger et al. | 52/506.07 |

(Continued)

FOREIGN PATENT DOCUMENTS

| | | |
|---|---|---|
| CH | 338949 | 6/1959 |
| EP | 0393000 | 10/1990 |

(Continued)

OTHER PUBLICATIONS

International Search Report and Written Opinion of corresponding International Application No. PCT/US2015/052132, issued Dec. 4, 2015. WO.

*Primary Examiner* — Robert Canfield
*Assistant Examiner* — Babajide Demuren
(74) *Attorney, Agent, or Firm* — Craig M Sterner

(57) ABSTRACT

A ceiling system in one embodiment includes an overhead support grid including a plurality of downward facing grid faces and an array of rectilinear grid openings. A plurality of grid-concealment ceiling panels are disposed in the grid openings and arranged diagonally such that corners of the panels are disposed proximate to mating corners of diagonally adjacent panels. Each panel includes peripheral edge portions which extend beneath and at least partially conceal grid faces surrounding the grid opening in which each panel is mounted. In one embodiment, the grid faces are completely concealed. Mating corners of ceiling panels meet at mutually configured chamfered corner surfaces which lie at cruciform intersections between the grid faces. The ceiling panels are arranged in diagonal rows in the support grid. Diagonal rows of filler ceiling panels are provided between diagonal rows of grid-concealment ceiling panels.

15 Claims, 20 Drawing Sheets

(56) References Cited

U.S. PATENT DOCUMENTS

| | | | | |
|---|---|---|---|---|
| 4,736,564 | A | 4/1988 | Gailey | |
| 5,182,893 | A * | 2/1993 | Goodworth | 52/745.05 |
| 5,507,125 | A * | 4/1996 | McClure | 52/506.07 |
| 6,108,994 | A * | 8/2000 | Bodine | 52/506.07 |
| 6,318,042 | B1 * | 11/2001 | Bloom et al. | 52/506.07 |
| 2003/0182894 | A1 * | 10/2003 | Galsgaard et al. | 52/747.1 |
| 2007/0130869 | A1 * | 6/2007 | Platt | 52/506.08 |
| 2009/0173030 | A1 * | 7/2009 | Gulbrandsen et al. | 52/506.09 |
| 2012/0042584 | A1 * | 2/2012 | Sareyka | 52/167.1 |
| 2012/0304575 | A1 * | 12/2012 | Vakhnin | 52/506.07 |

FOREIGN PATENT DOCUMENTS

| | | | |
|---|---|---|---|
| EP | 2631381 | A1 * | 8/2013 |
| FR | 2875520 | | 3/2006 |
| GB | 674893 | A * | 7/1952 |
| GB | 1277923 | | 6/1972 |
| GB | 2081332 | | 2/1982 |
| GB | 2163787 | A * | 3/1986 |
| GB | 2204073 | A * | 11/1988 |

* cited by examiner

CEILING SYSTEM

FIELD

The present invention relates to suspended ceiling systems with concealed support grids.

BACKGROUND

Numerous types of suspended ceiling systems and methods for mounting ceiling panels have been used. One type of system includes a suspended support grid including an array of intersecting grid support members configured to hang a plurality of individual ceiling panels therefrom. It is desirable in some cases to conceal the support grid for providing the appearance of a monolithic ceiling.

SUMMARY

A ceiling system is provided which conceals the ceiling support grid with a ceiling panel having peripheral edge portions that overlay the bottom grid face. The ceiling panel in certain embodiments may include edge portions on all sides that cover and conceal grid faces adjacent to the entire perimeter of the panel. In one embodiment, the ceiling system includes a combination of grid-concealment ceiling panels and filler panels which together form a complete concealed ceiling system having a monolithic ceiling appearance. In one arrangement, the grid-concealment ceiling panels are disposed in diagonal relationship to each other and each includes angled chamfered corners formed between the lateral sides. The chamfered diagonal corners of adjacent ceiling panels are abutted or disposed in relative close proximity beneath the grid face to conceal the corner grid regions between intersecting grid support members.

In one embodiment, a ceiling system includes: an overhead support grid including a plurality of downward facing grid faces and an array of rectilinear grid openings each configured for mounting a ceiling panel therein, each grid opening surrounded by a pair of longitudinally-extending grid faces and a pair of laterally-extending grid faces surface; a plurality of grid-concealment ceiling panels disposed in the grid openings, the grid-concealment ceiling panels being arranged diagonally to each other such that a corner of each grid-concealment ceiling panel is disposed proximate to a mating corner of a diagonally adjacent grid-concealment ceiling panel; wherein the grid-concealment ceiling panels each include peripheral edge portions which extend beneath the grid faces, the peripheral edge portions being configured to at least partially conceal the pair of longitudinally-extending grid faces and the pair of laterally-extending grid faces surrounding the grid opening in which each grid-concealment ceiling panel is disposed.

In another embodiment, a ceiling system includes: an overhead support grid configured for mounting ceiling panels, the support grid comprising: (i) a longitudinal axis; (ii) a plurality of longitudinal grid support members arranged parallel to the longitudinal axis, the longitudinal grid support members including a flange having a downward facing bottom surface; and (iii) a plurality of lateral grid support members arranged transversely between pairs of longitudinal grid support members, the lateral grid support members each having a flange defining a downward facing bottom surface, the longitudinal and lateral grid support members forming an array of rectilinear grid openings; a plurality of grid-concealment ceiling panels mounted in the grid openings, the grid-concealment ceiling panels each including a chamfered corner, each grid-concealment ceiling panel being arranged to meet one other grid-concealment ceiling panel disposed diagonally adjacent thereto at the chamfered corners of the grid-concealment ceiling panels; wherein the grid-concealment ceiling panels each include peripheral edge portions which completely conceal a pair of longitudinally-extending bottom surfaces and a pair of laterally-extending bottom surfaces surrounding the grid opening in which each grid-concealment ceiling panel is disposed.

A method for concealing a grid support member of a ceiling system is provided. The method includes the steps of: providing an overhead support grid including a plurality of grid support members each defining a downward facing bottom surface, the grid support members defining a plurality of bottom surfaces and an array of rectilinear grid openings each configured for mounting a ceiling panel therein; positioning a first ceiling panel in a first grid opening; positioning a second ceiling panel in a second grid opening, the second grid opening being located diagonally adjacent to the first grid opening; locating a chamfered corner of the first ceiling panel beneath intersecting bottom surfaces of the grid support members; and locating a chamfered corner of the second ceiling panel proximately adjacent to the chamfered corner of the first ceiling panel.

BRIEF DESCRIPTION OF THE DRAWINGS

The features of the exemplary embodiments of the present invention will be described with reference to the following drawings, where like elements are labeled similarly, and in which.

Figure 1:
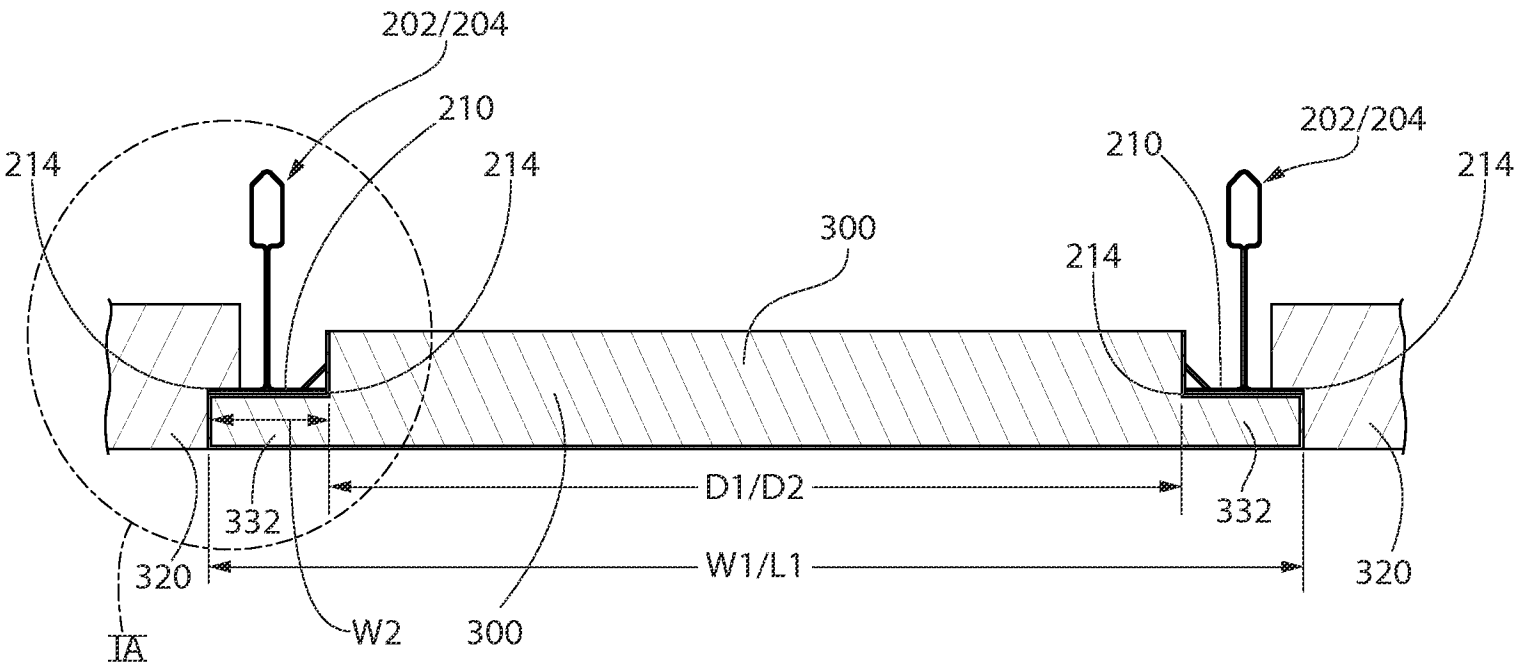
FIG. 1 is a side elevation cross-sectional view of a ceiling system comprising a support grid formed by grid support members and ceiling panels.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Figure 1A:
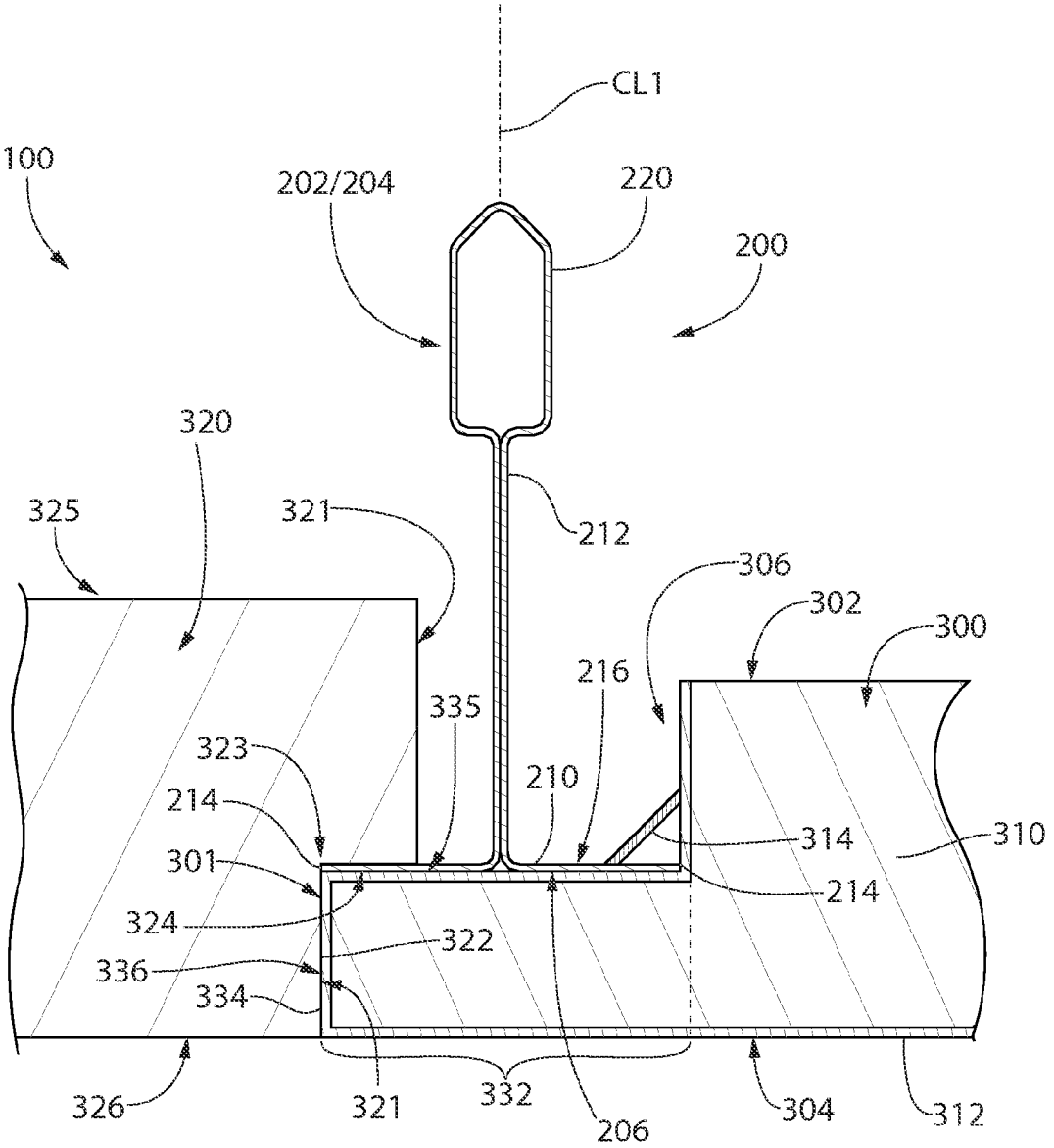
FIG. 1A is an enlarged view from FIG. 1.

FIGS. 1 and 1A depict an exemplary embodiment of a ceiling system 100 according to the present disclosure. The ceiling system 100 generally includes an overhead support grid 200, a first type of ceiling panel 300 supported by the grid support members for concealing the grid face, and a second type of ceiling panel 320 supported by the grid support members and interspersed between ceiling panels 300. Ceiling panels 300 may be grid-concealment ceiling panels configured and dimensioned to hide or conceal a portion of the grid face when mounted to the support grid 200. Ceiling panels 320 may be filler ceiling panels disposed between spaced apart ceiling panels 300 in the grid. The filler ceiling panels 320 are not configured to conceal the grid face in one embodiment. In one non-limiting configuration, the filler ceiling panels 320 may have a stepped tegular edge profile. Ceiling panels 300 and 320 have abutting peripheral edges to form a monolithic ceiling which hides the grid face from the occupied building space below, as further described herein.

Referring to FIGS. 1 through 4 (including FIG. 1A), the overhead support grid 200 is configured for mounting in a suspended manner from an overhead building support structure via appropriate hanger elements 203, such as for example without limitation fasteners, hangers, wires, cables, rods, struts, etc. Support grid 200 includes a plurality intersecting longitudinal grid support members 202 and lateral grid support members 204. Longitudinal and lateral grid support members 202, 204 are elongated in shape having a length greater than their respective width (e.g. at least twice), and in various embodiments lengths substantially greater than their widths (e.g. 3 times or more). Longitudinal grid support member 202 may have a substantially greater length than lateral grid support member 204 and form "runners" or "rails" which are maintained in a substantially parallel spaced apart relationship by the lateral grid support members. The lateral grid support members 204 may be attached to and between adjacent (but spaced apart) longitudinal grid support members 202 at appropriate intervals using any suitable permanent or detachable coupling means. The combination of interconnected longitudinal and lateral grid support members 202, 204 provides strength and lateral stability to the support grid 200.

In one embodiment, grid support members 202 and 204 may be horizontally oriented when installed. It will be appreciated, however, that other suitable mounted orientations of grid support members 202, 204 such as angled or sloped (i.e. between 0 and 90 degrees to horizontal) may be used. Accordingly, although support members 202, 204 may be described in one exemplary orientation herein as horizontal, the invention is not limited to this orientation alone and other orientations may be used.

Longitudinal and lateral grid support members 202, 204 intersect to form an array of grid openings 208 which become essentially closed by ceiling panels 300 and 320 when positioned within the openings. In some embodiments, the grid support members 202, 204 may be arranged in an orthogonal pattern wherein the support members intersect at right angles to form rectilinear grid openings 208 such as squares or rectangles (in top plan view). The terminal ends of the lateral grid support members 204 may be configured for permanent or detachable connection to the longitudinal grid support members 202 at right angles to form a rectilinear grid pattern using any suitable means. Non-limiting examples of suitable connection means include welding, soldering, clips, brackets, threaded fasteners, interlocking tabs/slots, etc. Accordingly, the present invention is not limited by the manner of attachment used.

With continuing reference to FIGS. 1 through 4, grid support members 202, 204 may be T-shaped (e.g. T-rails) in transverse cross section. The grid support members have an inverted T-shaped configuration in an installed position suspended from an overhead building ceiling support structure. Grid support members 202, 204 may each include a longitudinally-extending horizontal bottom flange 210, an enlarged top stiffening channel 220, and a vertical web 212 extending upwards from the flange to the stiffening channel. In some embodiments, the top stiffening channel 220 may be omitted from grid support members 202 and/or 204.

The longitudinal and lateral grid support members 202, 204 each define a respective longitudinal axis LA and axial directions; the lateral grid support members 204 being arranged transversely thereto. Bottom flange 210 is substantially horizontally oriented when in an installed position in the embodiment shown (see, e.g. FIGS. 1 and 2) and has opposing portions which extend laterally outwards from web 212 and terminate in opposed axially extending longitudinal edges 214. Web 212 may be centered between the edges 214 and vertically aligned with the centerline CL1 of the grid support member in some embodiments. In other embodiments, the web 212 may be laterally offset from centerline CL1 of the grid support member 202 or 204.

With continuing reference to FIGS. 1 through 4, the bottom flanges 210 of grid support members 202, 204 each includes a downward facing bottom surface 206 that defines the grid face typically visible from the occupied room or space below the support grid 200. Bottom surface 206 defines a horizontal ceiling reference plane for the overhead support grid 200. Flange 210 further defines an upward facing top surface 216 for positioning and supporting the ceiling panels 300 and 320 thereon in some embodiments. Longitudinal grid support members 202 may be configured similarly or the same as lateral grid support members 204, or each may be different. Regardless of the configurations used for grid support members 202 and, 204, each includes bottom flanges 210 and downward facing flange surfaces 206 which preferably lie in the same horizontal plane in one embodiment when hung from an overhead support structure. In one embodiment shown in FIG. 3, the enlarged top stiffening channel 220 may be omitted from lateral grid support members 204 to facilitate mounting to the longitudinal grid support members 202. Furthermore, the terminal end portions of the bottom flanges 201 of lateral grid support members 204 may further be omitted when fabricated or notched/cut off in the field to also facilitate the mounting as shown in this figure.

Grid support members 202 may be made of any suitable metallic or non-metallic materials structured to support the dead weight or load of ceiling panels 300 without undue deflection. In some non-limiting embodiments, the grid support members may be made of metal including aluminum, titanium, steel, or other. In some non-limiting embodiments, the grid support members 202 may be a standard heavy duty 15/16 inch aluminum T-rail having a 15/16 inch grid face or 9/16 inch T-rail having a narrow 9/16 inch grid face.

The grid-concealment ceiling panels 300 will now be described in further detail. Referring now FIGS. 1, 1A, and 5-8, ceiling panels 300 may have a generally flattened body with a substantially greater horizontal width and length than vertical thickness as shown. Ceiling panel 300 includes a top surface 302, bottom surface 304, and lateral sides 306 extending therebetween along the perimeter of the ceiling panel. Top and bottom surfaces 302, 304 may be generally planar and arranged substantially parallel to each other in one non-limiting embodiment. Lateral sides 306 may have numerous possible configurations including flat, stepped, angled, or various combinations thereof and other shapes.

In certain embodiments as shown, ceiling panel 300 may be a composite structure comprised of a material core 310 enclosed at least partially by an outer metal frame 312. In one embodiment, the frame may completely enclose the bottom surface 304 and lateral sides 306 of the ceiling panel (best shown in FIG. 1A). Other arrangements and configurations of frames 312 may be used which cover varying parts of ceiling panel 300. The core 310 may be formed of a lower density non-metal material, for example without limitation mineral fiber, fiberglass, or other. The metal frame 312 may be in the form of a thin sheet of metal bent or otherwise formed to shape to form a skin for the core. Metal frame 312 may be made of a suitable metal and is preferably relatively light in weight to reduce the dead load on the overhead grid support 200. Suitable metals may include, without limitation, aluminum, titanium, light-weight steel, or other metal. In other possible embodiments, a non-metal frame may be used such as woven or non-woven scrims or facings.

In some embodiments as shown in FIG. 1A, a fastening mechanism 314 may be provided for attaching the ceiling panel 300 to the flange 210 of grid support members 202 and 204. In the present embodiment shown, the fastening mechanism 314 may be a spring clip which is formed as an integral part of the metal frame 312. Other variations of possible fastening mechanisms 314 are shown in FIGS. 10-18 which are configured to function with various peripheral edge portion 332 constructions and configurations of the ceiling panel 300 for securing the ceiling panel to the grid support member. Possible fastening mechanisms 314 include clips, brackets, threaded fasteners, interlocking joints, and others.

Figure 9:
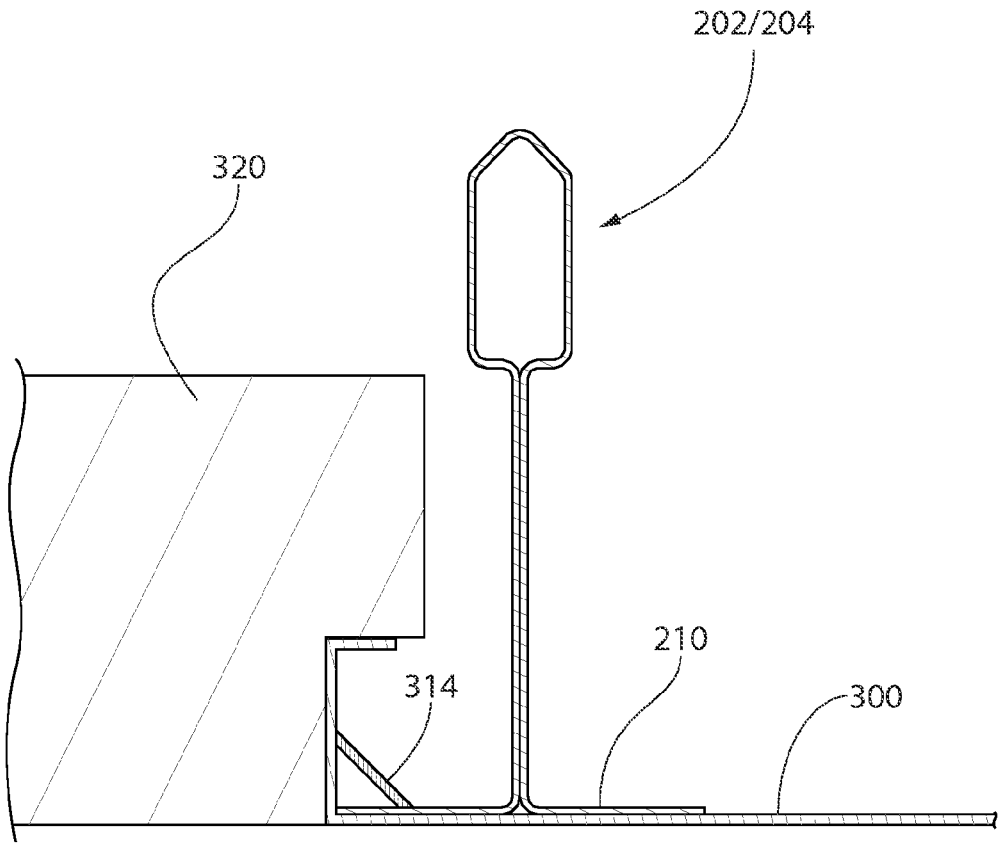
FIGS. 9-18 show various embodiments and configurations of ceiling panels mountable to the grid support members.
Figure 10:
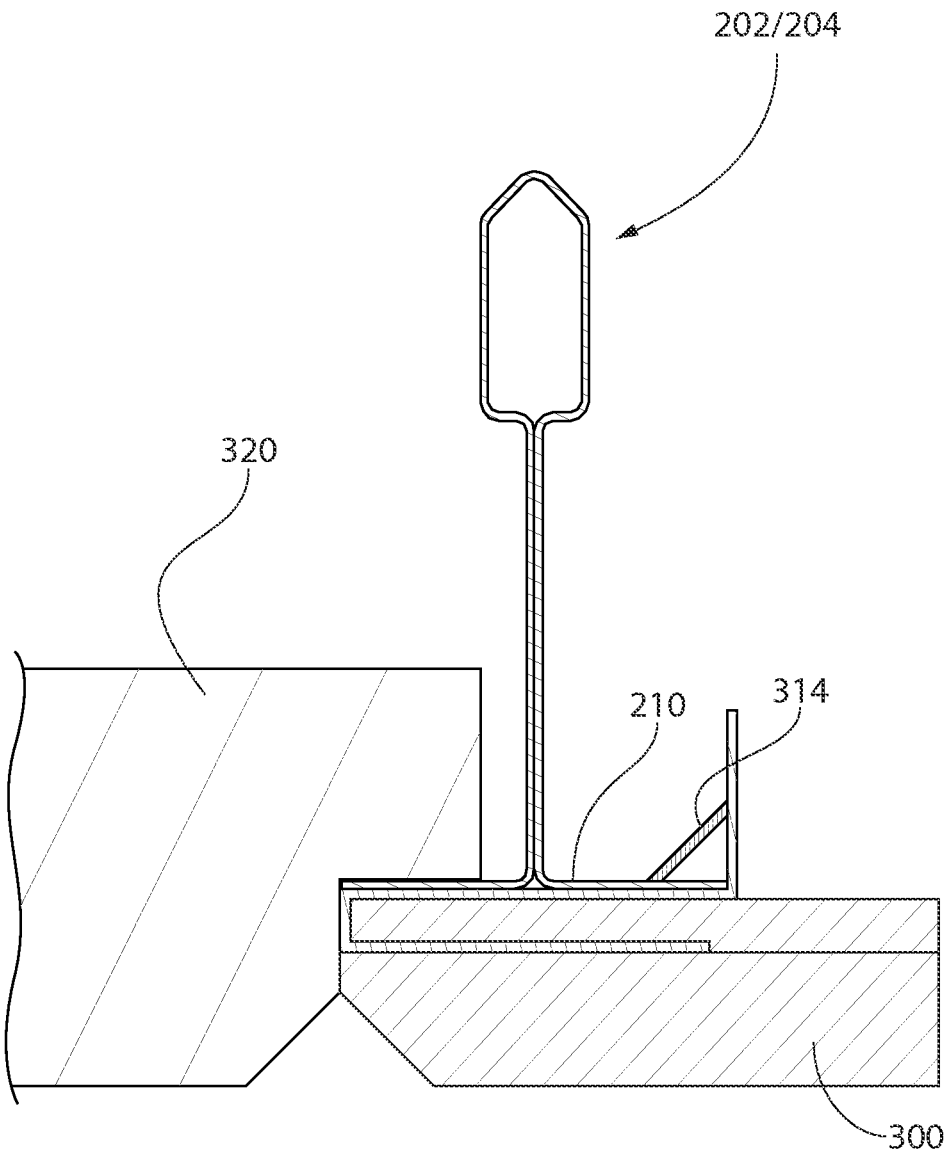
Figure 11:
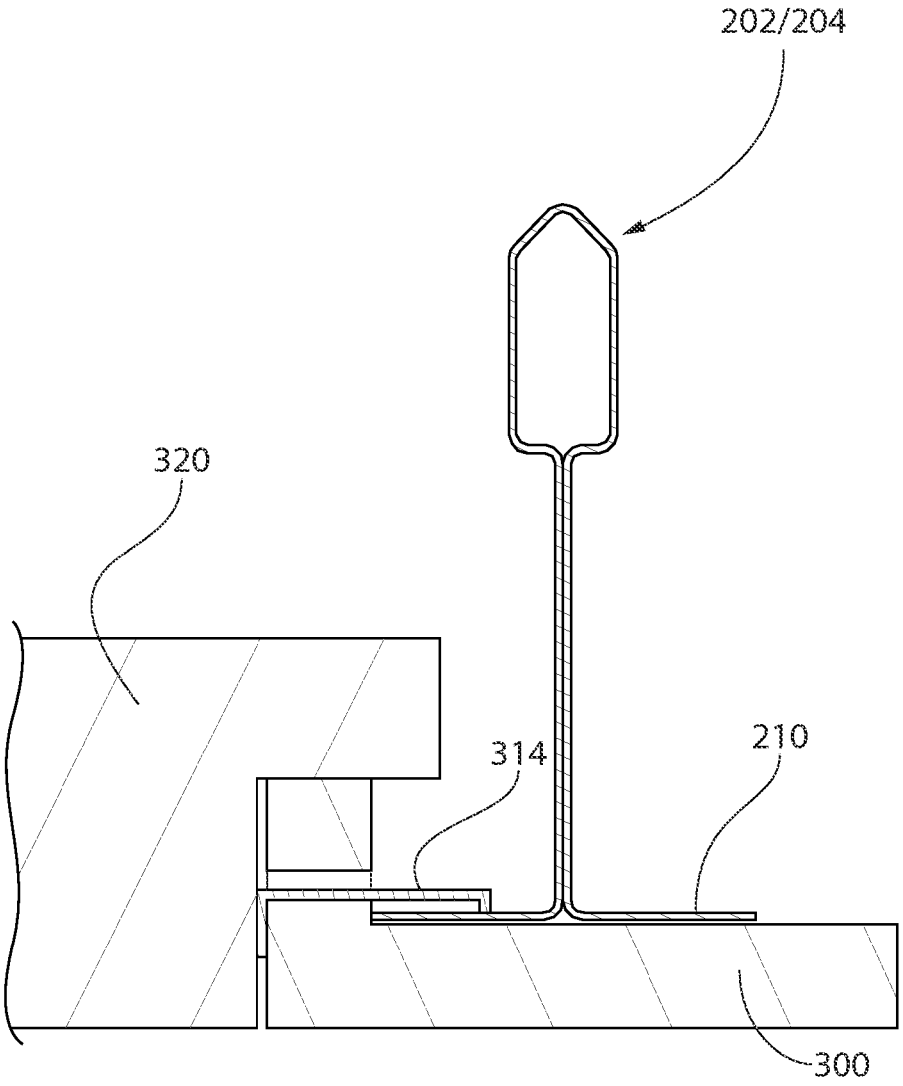
Figure 12:
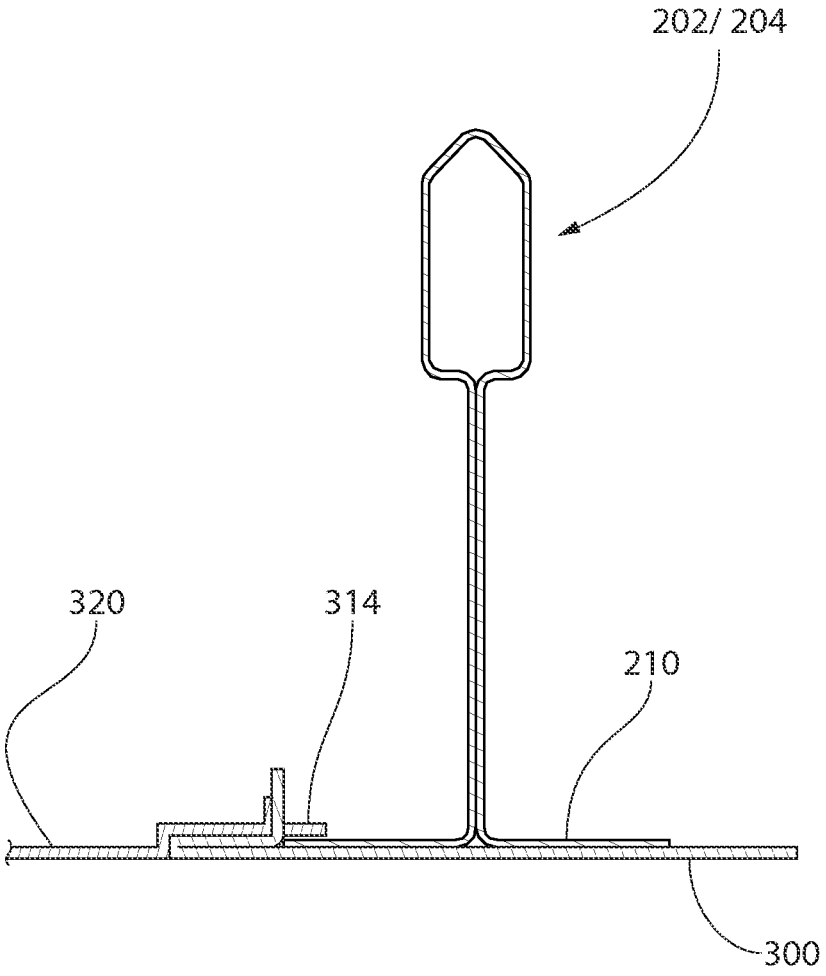
Figure 13:
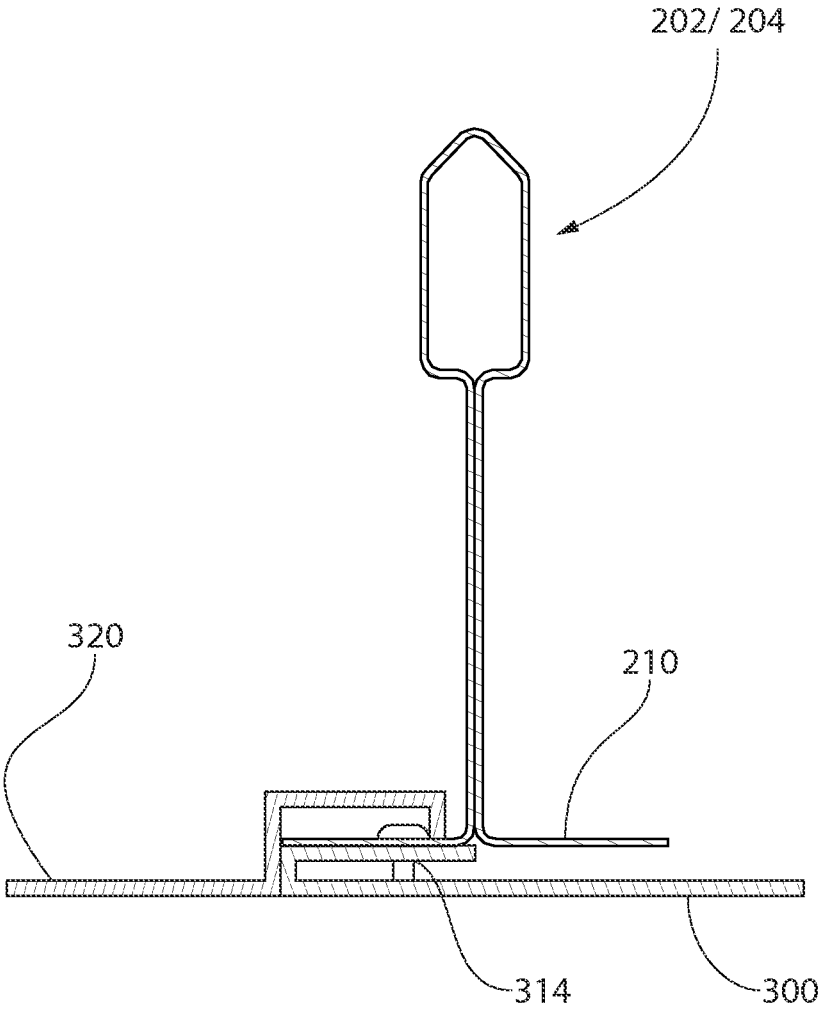
Figure 14:
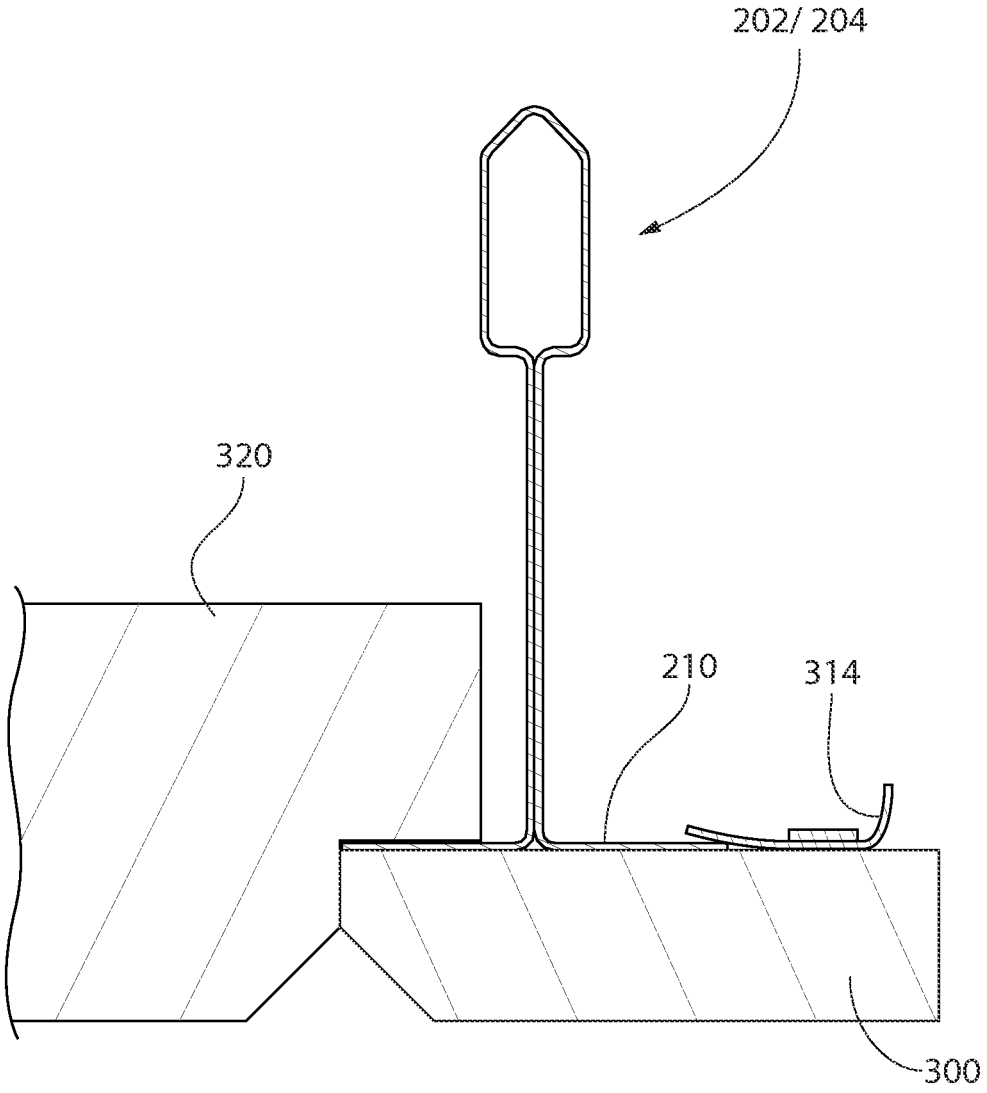
Figure 15:
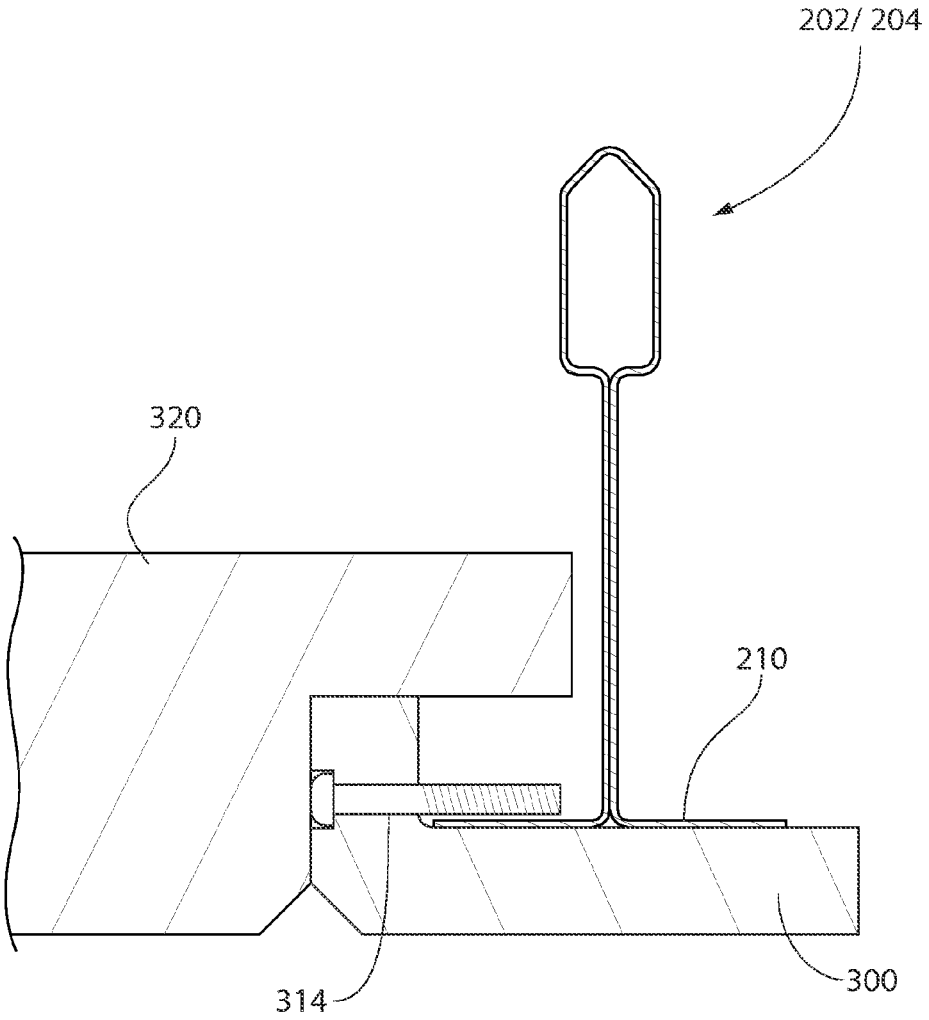
Figure 16:
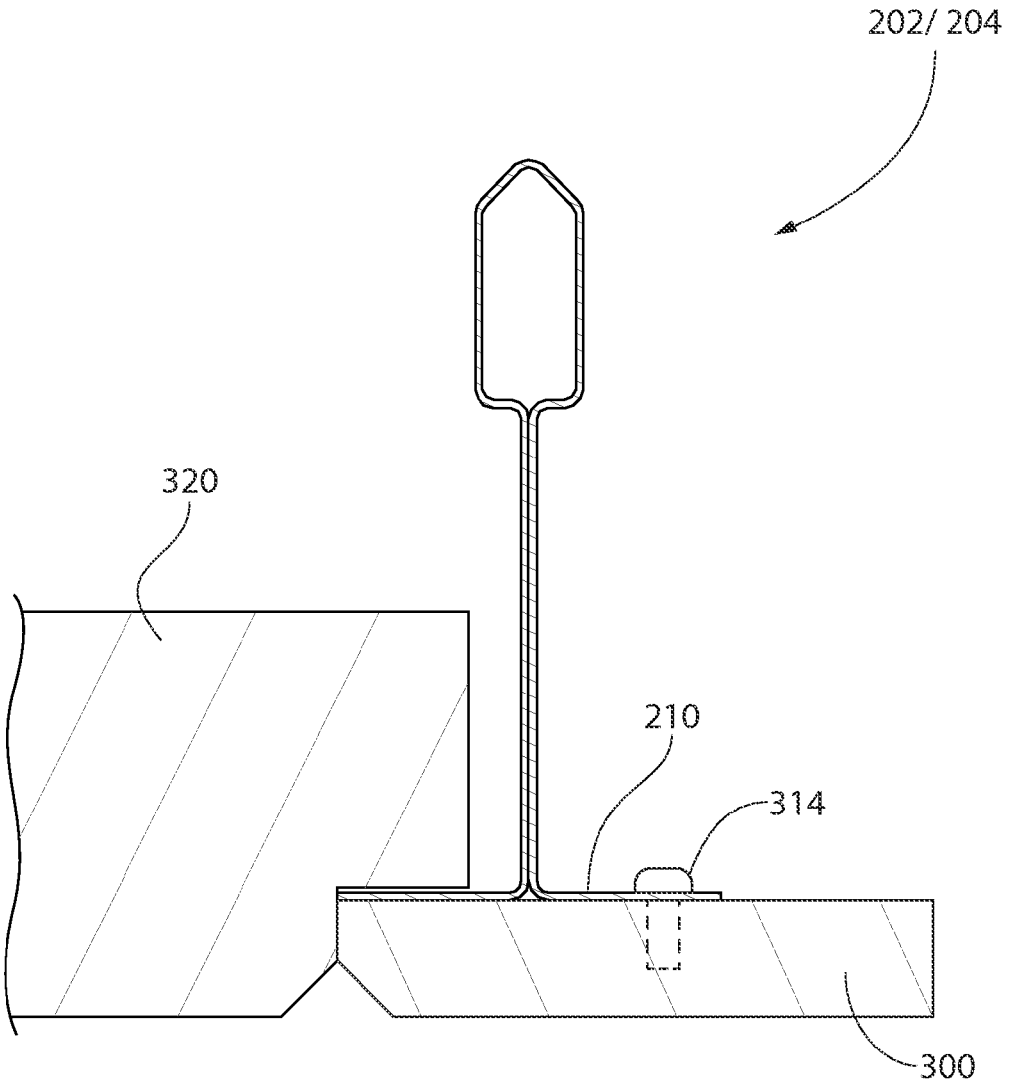
Figure 17:
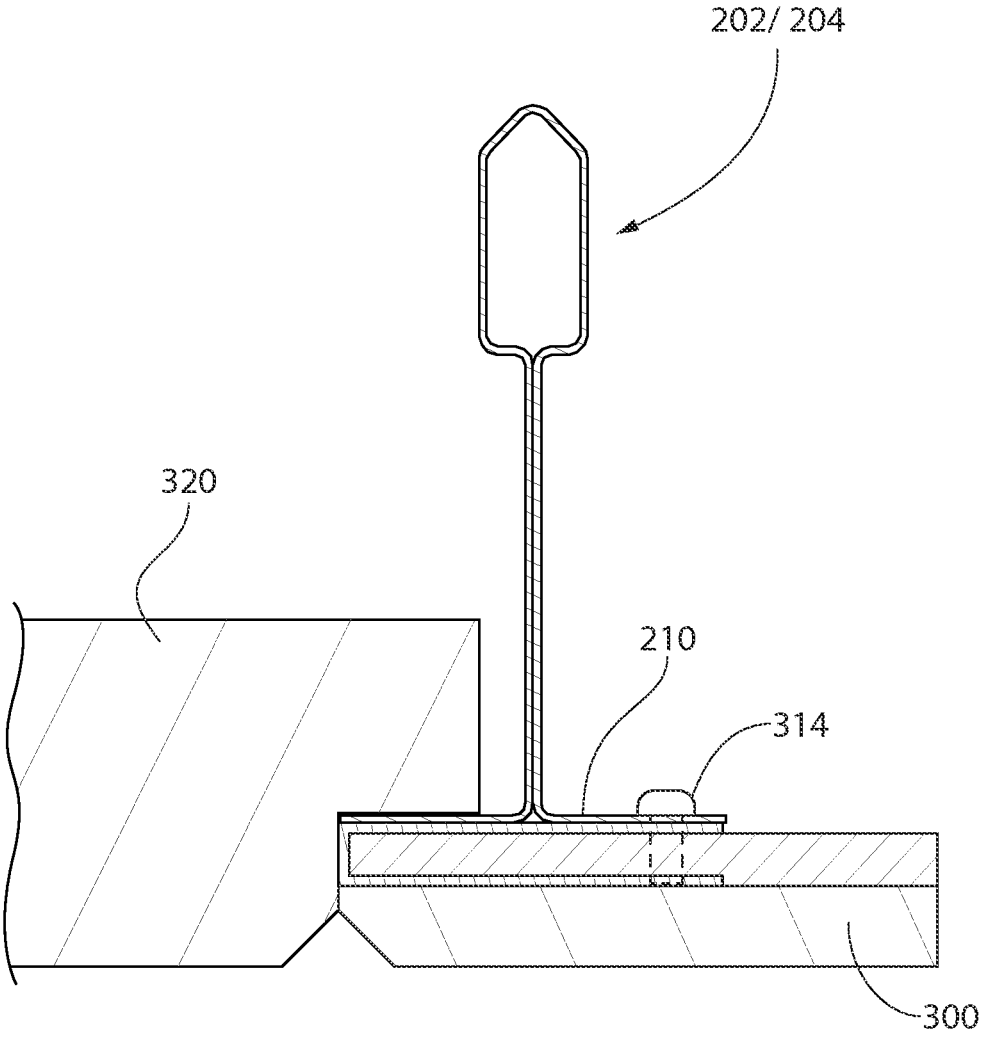
Figure 18:
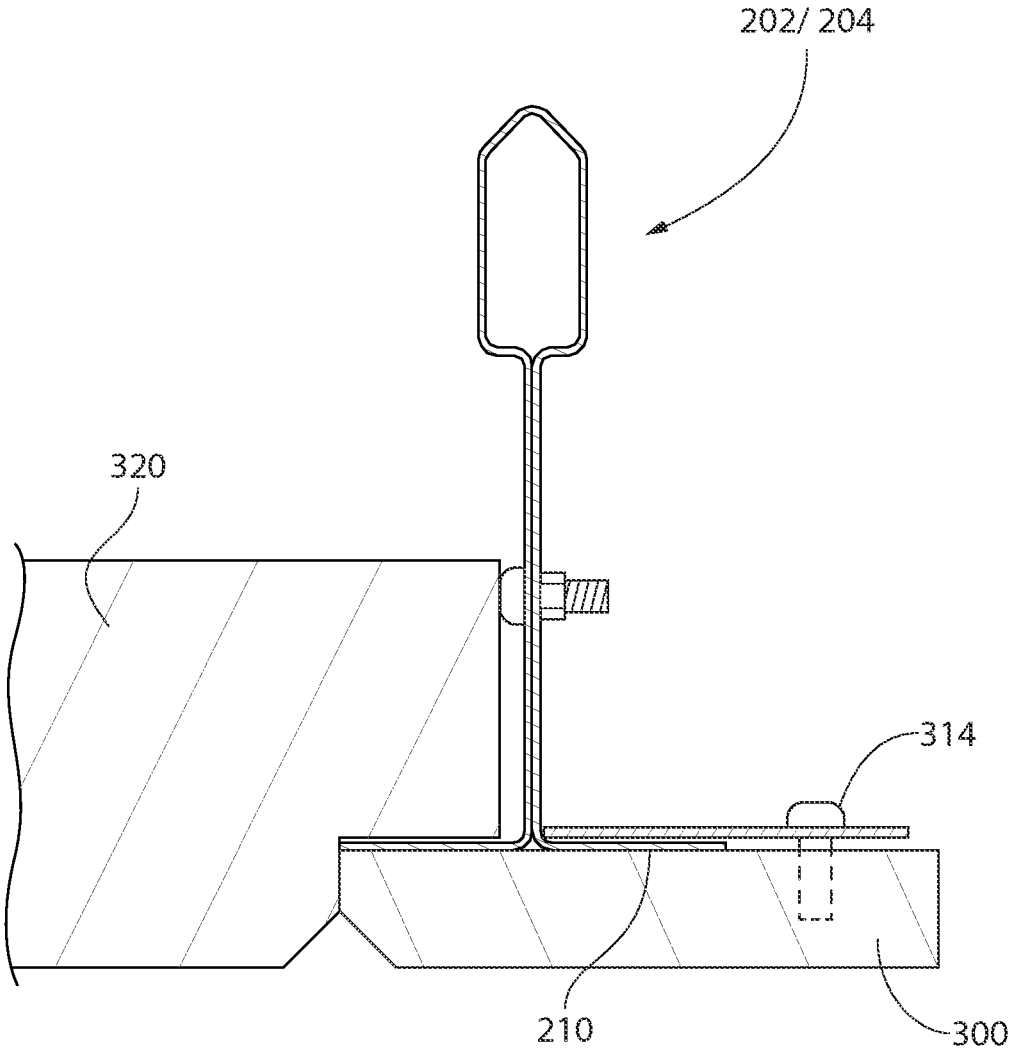

It will be appreciated that in other possible embodiments, no metal frame can be provided (see, e.g. FIGS. 10, 11, 14-18), or no core can be provided and the ceiling panel 300 is formed entirely of metal (see, e.g. FIGS. 9, 12, and 13). Accordingly, numerous variations in terms of construction and configurations of ceiling panels 300 are possible for concealing the grid face. The type of ceiling panel 300 construction and materials selected do not limit the scope or applicability of the invention.

In some embodiment, ceiling panels 300 may have a rectilinear shape (best shown in FIGS. 5 and 8), such as without limitation square or rectangular. Each ceiling panel 300 includes four corners 331 and peripheral edge portions 332 extending around the perimeter of the panel that defines corresponding linear peripheral edges 334. Edges 334 define outward facing peripheral edge surfaces 301 which may be configured to abuttingly contact mating edge surfaces 321 of tegular ceiling panels 320 to completely hide the grid face (see, e.g. FIGS. 1A, 5, and 7), as further described herein.

Grid-concealment ceiling panels 300 are configured and dimensioned to hide the grid face of the overhead support grid 200 (i.e. bottom surface 206 of the grid support members 202 and 204). Accordingly, referring to FIGS. 1, 1A, and 2, ceiling panels 300 each have a horizontal longitudinal length L1 (measured parallel to longitudinal axis LA) which is larger than the corresponding horizontal longitudinal distance D1 (measured parallel to longitudinal axis LA) between the inner longitudinal edges 214 (i.e. closest distance) of two adjacent albeit spaced apart grid lateral grid support members 204. In some embodiments, ceiling panels 300 may each further have a horizontal lateral width W1 (measured transversely to longitudinal axis LA) which is larger than the corresponding horizontal lateral distance D2 (measured transversely to longitudinal axis LA) between the inner longitudinal edges 214 (i.e. closest distance) of two adjacent albeit spaced apart grid longitudinal grid support members 202. In one embodiment, length L1 is substantially equal to distance D1 plus the width W2 of each of the two flanges 210 of the lateral grid support members 204 which support both opposite laterally-extending sides 306 of the panel. Similarly, in one embodiment, width W1 is substantially equal to distance D2 plus the width W2 of each of the two flanges 210 of the longitudinal grid support members 202 which support both opposite longitudinally-extending lateral sides 306 of the panel. The peripheral edges 334 of each ceiling panel therefore terminate at a point coextensive with the outermost longitudinal edges 214 of each pair of adjacent but spaced apart longitudinal and lateral grid support members 202, 204.

Accordingly, when configured and dimensioned in the foregoing manner, the peripheral edge portions 332 of each ceiling panel 300 overlap and extend entirely beneath the flange bottom surfaces 206 of both the two opposing longitudinal grid support members 202 and two opposing lateral grid support members 204 between which the ceiling panels are mounted, thereby completely concealing the grid face. Perimeter regions of top surface 302 of each ceiling panel 300 define upward facing substantially planar peripheral top surfaces 335 which may either contact or fall in close proximity to bottom surfaces 206 of grid support members 202 and 204 when the ceiling panel is mounted therefrom as shown in FIGS. 1 and 1A.

Filler ceiling panels 320 include a top surface 325, bottom surface 326, and outward facing peripheral edge surfaces 321 extending therebetween along the perimeter of the ceiling panel (see FIG. 1A). Peripheral edge surfaces 321 correspondingly define linear peripheral edges 322. Top and bottom surfaces 302, 304 may be generally planar and arranged substantially parallel to each other in one non-limiting embodiment. Peripheral edge surfaces 321 and edges 322 may have numerous possible configurations including flat, stepped, angled, or various combinations thereof and other shapes. In one embodiment, the peripheral edges 322 may have a stepped tegular shape forming a tegular ceiling panel 320.

Figure 7:
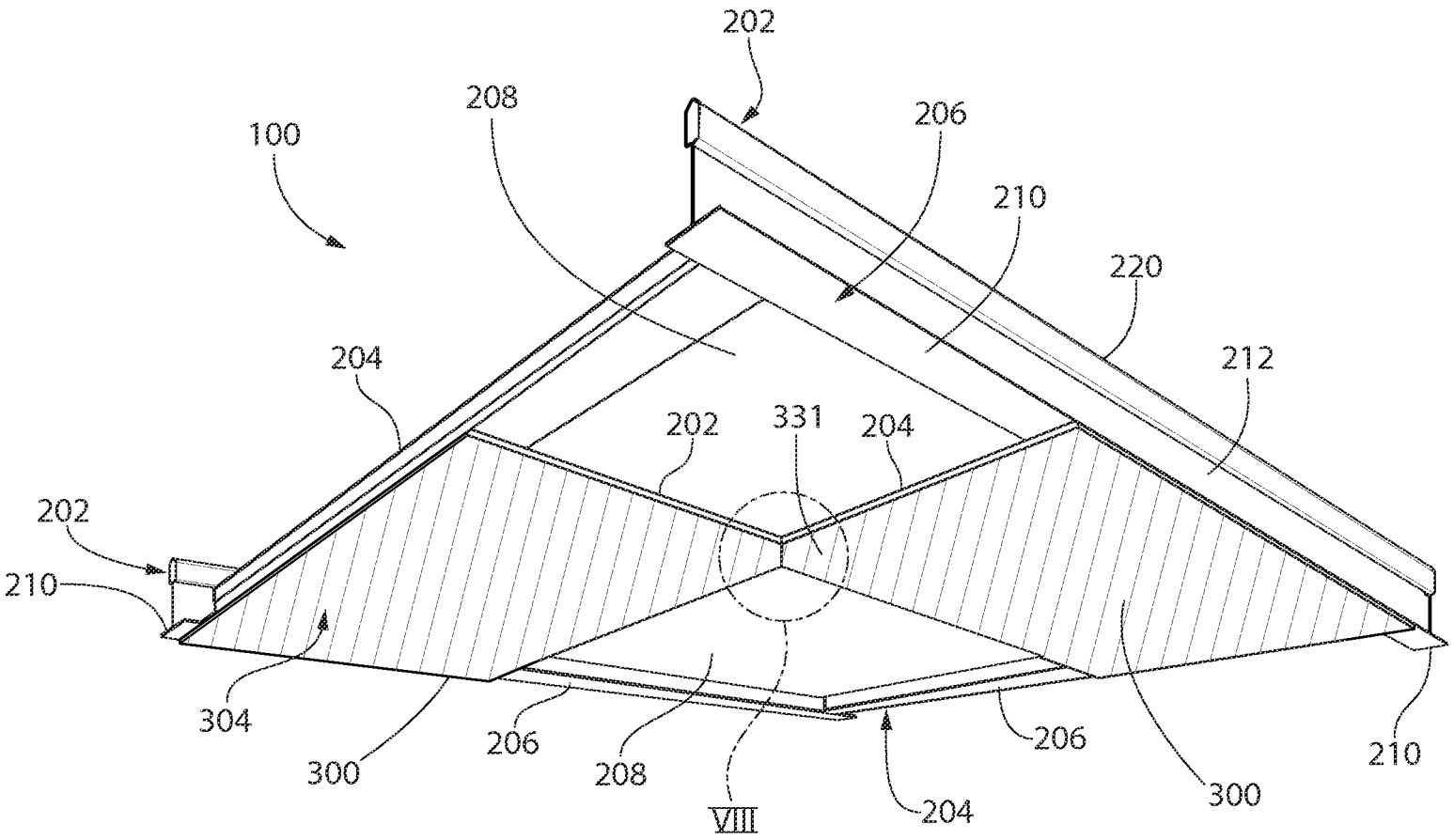
FIG. 7 is a bottom perspective view of the grid support member with grid-concealment ceiling panels mounted in the support grid.
Figure 8:
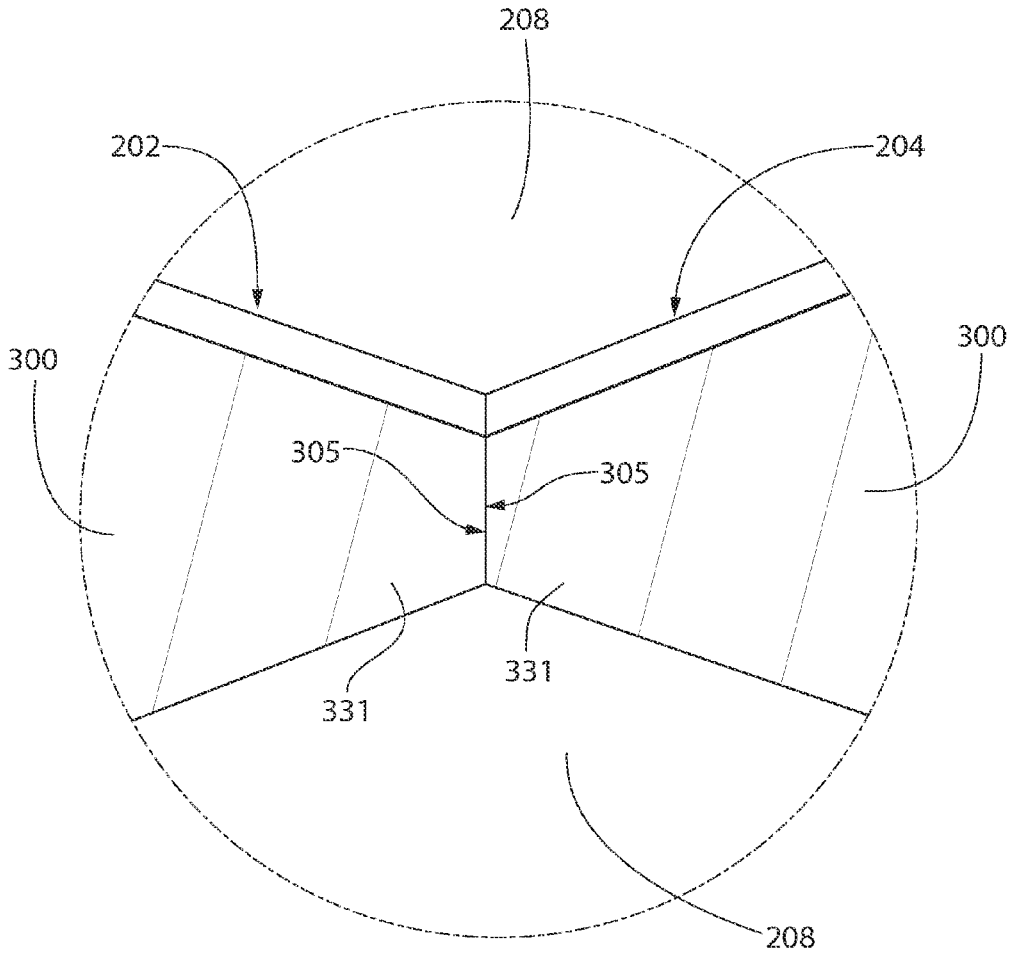
FIG. 8 is an enlarged view from FIG. 7.

In some embodiments, the filler ceiling panels 320 when mounted in the empty grid openings 208 shown in FIG. 7 may be configured to terminate at the innermost or near side longitudinal edges 214 between the adjacent spaced apart longitudinal or lateral grid support members 202, 204 which support each respective panel 320. This positions at least a lower portion of the peripheral edge surfaces 321 and edges 322 beneath bottom surface 206 of the grid support members to mate with and abuttingly contact (or fall in preferably very close proximity to) the outward facing peripheral edge surfaces 336 and edges 334 of ceiling panels 300, as shown in FIGS. 1 and 1A. The combination of ceiling panels 300 and 320 thereby form a monolithic ceiling system which conceals the entire grid face (i.e. bottom surface 206) formed by grid support members 202 and 204. The bottom surfaces 304 and 326 of ceiling panels 300 and 320 respectively are positioned on the same horizontal reference plane in flush relationship.

It should be noted that in some embodiments, it may be desirable for certain visual effects to leave the grid face fully or partially exposed along either the laterally-extending or longitudinally-extending peripheral sides 306 of ceiling panels 300. Accordingly, in such embodiments, the length L1 or width W1 of the ceiling panels 300 may be substantially equal to distances D1 or D2, respectively to expose the full grid face on opposing sides of the ceiling panel 300. In related but varied embodiments, the length L1 or width W1 may be greater than their respective corresponding distances D1 or D2 but less than D1 or D2 plus the full width W2 of both bottom flanges 210 of the longitudinal or lateral grid support members 202, 204 at the opposite peripheral sides 306 of the panels 300 to partially expose the grid face. Numerous variations are therefore possible.

The tegular peripheral edges 334 of ceiling panels 320 shown in FIGS. 1 and 1A include a shoulder 323 extending around the perimeter of the ceiling panels. This creates the stepped tegular edge configured for engaging with the flanges 210 of grid support members 202, 204. In one embodiment, shoulders 323 and adjoining downward facing horizontal peripheral surfaces 324 are positioned to engage the longitudinal edges 214 and adjoining top surface 216 of the grid support members 202 and 204 (best seen in FIG. 1A). When mounted in the overhead grid support 200, the bottom surface of the filler ceiling panels 320 may be substantially flush with the bottom surface 304 of the grid-concealment ceiling panels 300. In other possible embodiments, ceiling panels 320 or 300 may be dimensioned to intentionally extend below the other type of ceiling panel to form a ceiling system with alternating height panels.

In order to form the monolithic ceiling system 100, the grid-concealment ceiling panels 300 and ceiling panels 320 are mounted and arranged in alternating fashion within each longitudinally extending row of panels (i.e. parallel to the longitudinal axis LA) and each laterally extending row of panels (i.e. transverse to the longitudinal axis LA). Accordingly, in both the longitudinal and lateral directions of the ceiling panel array in ceiling system 100, every other panel is a grid-concealment ceiling panel 300 with a filler ceiling panel 320 disposed therebetween. This arrangement positions the ceiling panels 300 in a diagonal relationship to each other which meet only at the corners 331 of adjacent ceiling panels in other rows as shown in FIGS. 5-8.

Because each ceiling panel 300 in some embodiments is dimensioned to conceal the entirety of each of the four grid faces (i.e. bottom surfaces 206 of grid support members 202 and 204) surrounding the grid opening 208 in which the panels 300 are mounted as described herein (reference FIGS. 1, 1A, 2, and 5-8), the corners 331 of adjacent ceiling panels 300 would create interference at the mating corner regions if square panel corners 331 were to be provided. This would prevent mounting the panels 300 in the flush manner disclosed herein. To overcome this problem, in one embodiment the corners 331 of the ceiling panels 300 may each include a 45 degree angled chamfer 307 (angle measured with respect to each intersecting lateral side 306 of the panel at the corners). The chamfers 307 each define corresponding planar diagonal or angled chamfered corner surfaces 305 which face outwards and are disposed diagonally at a 45 degree angle to each of the intersecting lateral sides 306 at each corner 331 of the ceiling panels 300. When two diagonally arranged ceiling panels 300 are therefore installed in diagonally adjacent grid openings 208, the adjoining chamfers 307 of each ceiling panel 300 are placed in abutting contact or close proximity to each other beneath the bottom surfaces of intersecting longitudinal and lateral grid support members 202, 204, as shown in FIGS. 5-8. Advantageously, this arrangement permits placement of the bottom surfaces 304 of each panel in a substantially flush relationship falling with each other within the same horizontal reference plane. Because the two adjoining/adjacent chamfers 307 are located beneath the bottom surfaces 206 of the grid support members 202, 204, there are no intervening structures between the chamfered (e.g. parts of the grid support members 202, 204).

Ceiling panels 300 and 320 may be constructed of any suitable material or combinations of different materials forming a composite construction. Non-limiting examples of ceiling panel materials that may be used include, without limitation, mineral fiber board, fiberglass, metals, polymers, wood, composites, combinations thereof, or other. In some embodiments therefore, the ceiling panels may be made entirely of metal, entirely a non-metal, or be a combination of a non-metal core material with a full or partial metal frame as described above and shown in FIGS. 1 and 1A. In addition, the ceiling panels 300 may have any suitable dimensions and shapes (in top plan view) including without limitation square or rectangular.

Figure 2:
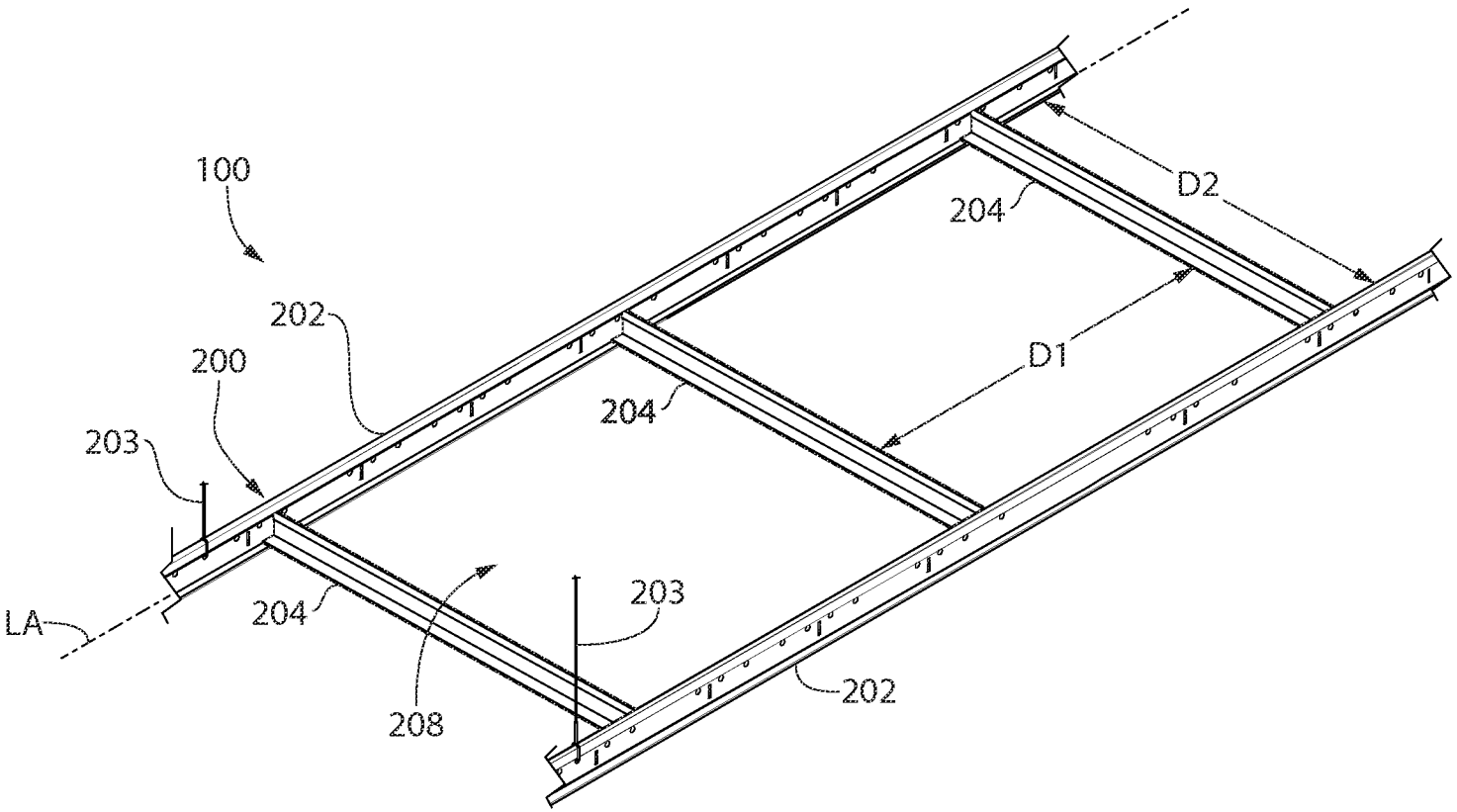
FIG. 2 is top perspective view of grid support members.
Figure 3:
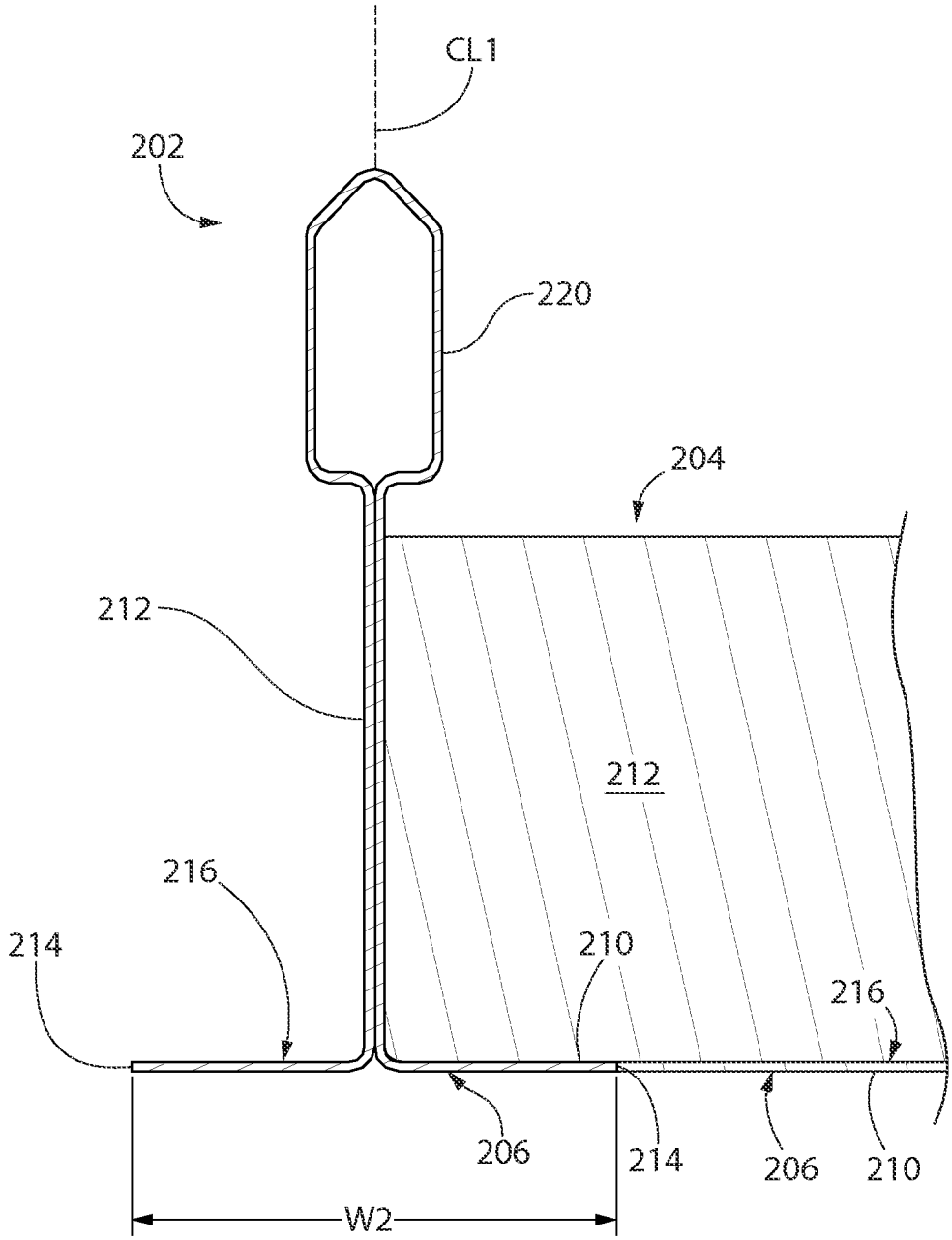
FIG. 3 is a side cross-sectional view of intersecting longitudinal and lateral grid support members.
Figure 4:
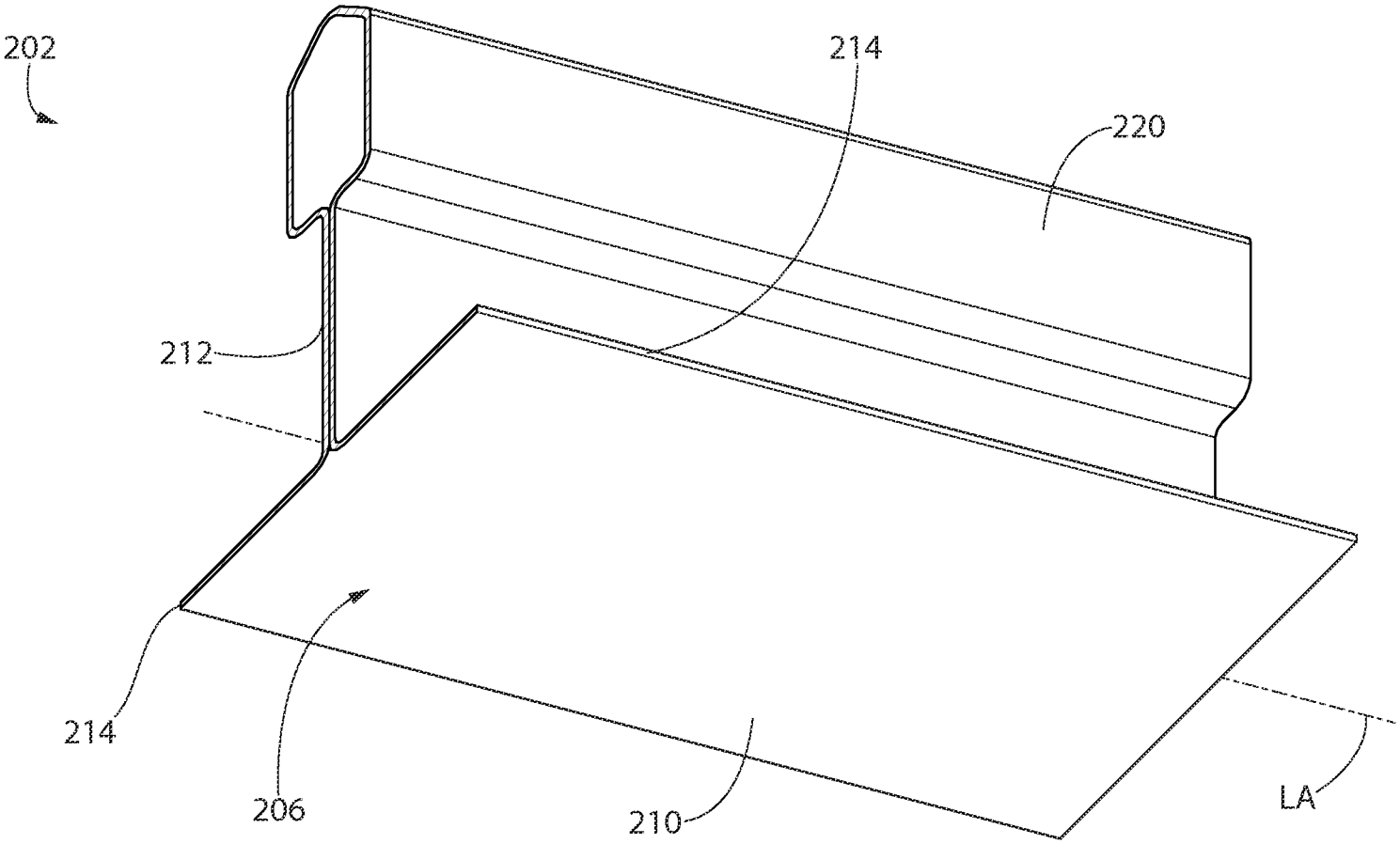
FIG. 4 is a cross-sectional bottom perspective view of the longitudinal grid support members.
Figure 5:
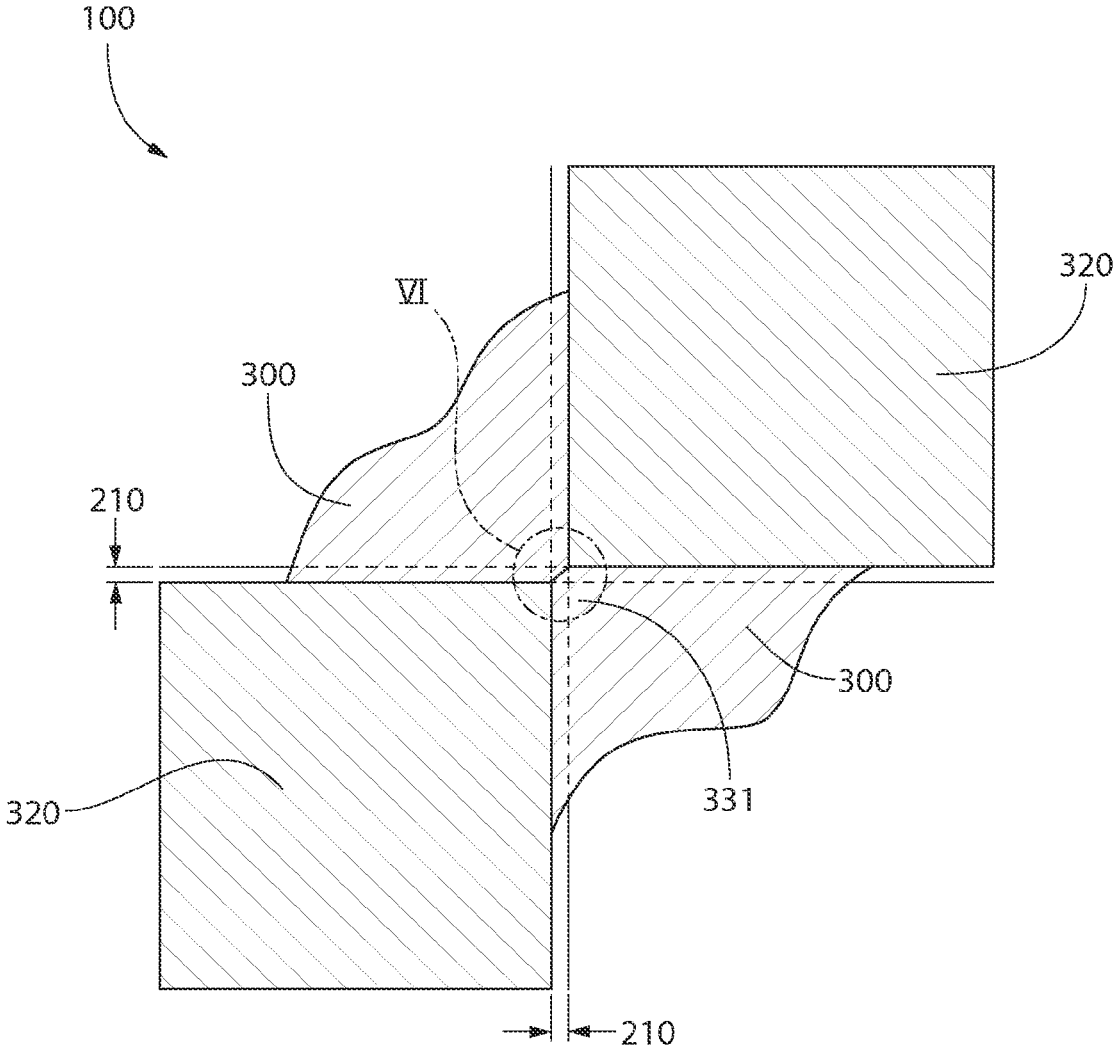
FIG. 5 is a top plan view of a portion of the ceiling system.
Figure 6:
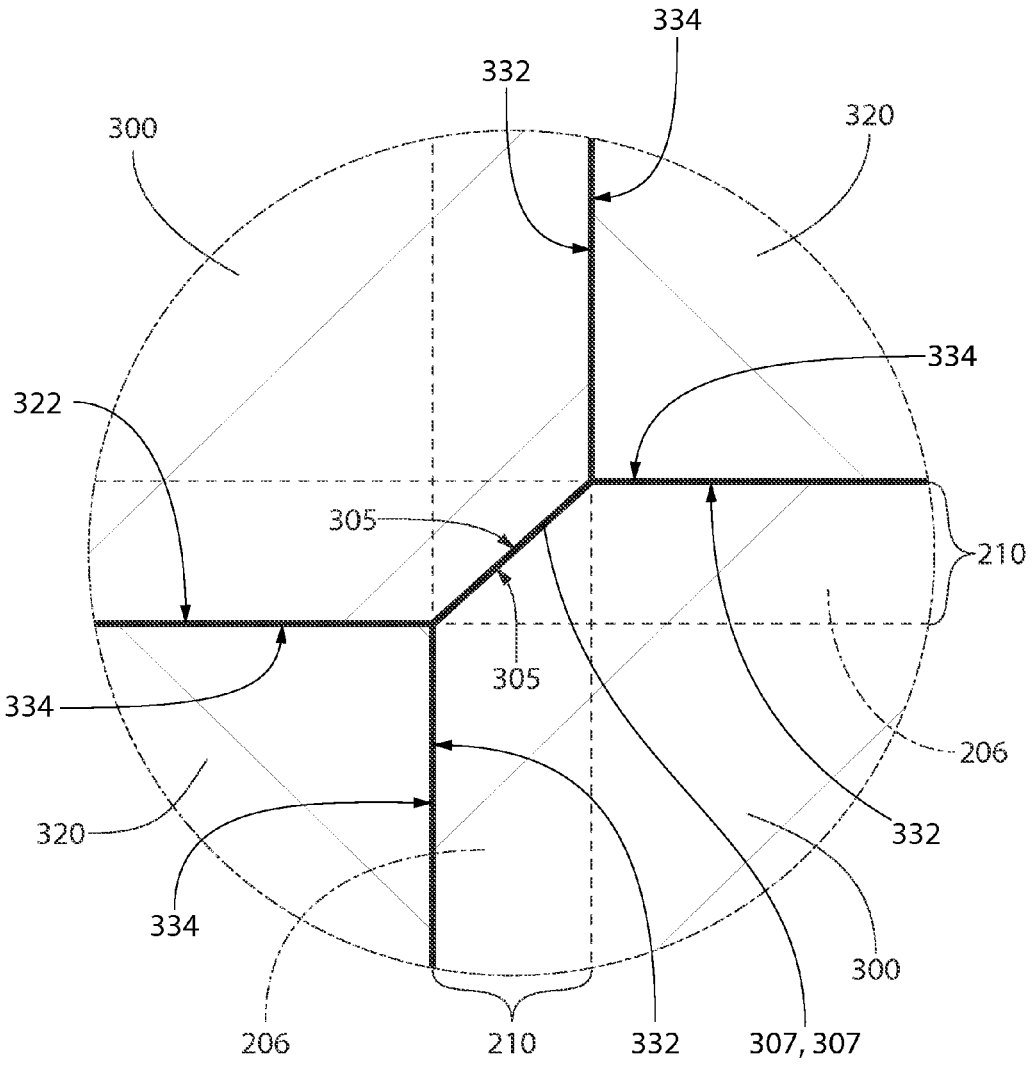
FIG. 6 is an enlarged view from FIG. 5.

A method for concealing grid support members 202, 204 of a ceiling system 100 will now be described with initial reference to FIGS. 1, 2, and 7.

A plurality of longitudinal grid support members 202 are provided and hung from an overhead ceiling support structure in parallel relationship to each other in the arrangement as shown. The grid support members 202 are horizontally spaced apart and defining a longitudinal axis LA. The bottom flange 210 of each grid support member 202 substantially lies in a common horizontal reference plane.

A plurality of lateral grid support members 204 are provided and hung from an overhead ceiling support structure in parallel relationship to each other in the arrangement as shown. The grid support members 202 are horizontally spaced apart transversely to the longitudinal axis LA between the longitudinal grid support members 202 and are attached thereto at their terminal ends. The lateral grid support members 204 may be oriented orthogonally and perpendicular to the longitudinal grid support members 202 and longitudinal axis LA. The bottom flange 210 of each lateral grid support member 204 substantially lies in a common horizontal reference plane with the other grid support members 204 and longitudinal grid support members 202. The bottom surfaces 206 of the grid support members 202, 204 each define a grid face.

The intersecting longitudinal and lateral grid support members 202, 204 define an array of grid openings 208 each configured to receive either a grid-concealment ceiling panel 300 or filler ceiling panel 320. The grid openings 208 may be rectilinear and are each surrounded by a pair of opposing longitudinally-extending grid faces and a pair of opposing laterally-extending grid faces surface (best shown in FIGS. 2 and 7). In some embodiments, the grid openings 208 may be orthogonal.

The method continues by now mounting the ceiling tiles in one embodiment. A first grid-concealment ceiling panel 300 is mounted in a first grid opening. The panel 300 may be attached to the grid support members 202 and 204 surrounding the respective grid opening 208 by any suitable means, including the non-limiting exampled disclosed herein such as by using fastening mechanisms 314 or other mounting techniques described, or others. The peripheral edge portions 332 of the first ceiling panel 300 are located or placed beneath and overlap the bottom surfaces 206 (e.g. grid faces) of the grid support members 202 and 204 adjacent the respective grid opening 208. Accordingly, the peripheral edge portions 332 may cover the bottom surfaces 206 or grid faces on all four sides of the ceiling panel 300, either completely in a manner which fully conceals the grid faces or partially to intentionally leave a portion of the grid faces exposed and visible from below the ceiling system 100.

In one embodiment, the peripheral edge portions 332 completely cover and conceal the four bottom surfaces 204 or grid faces surrounding grid opening 208. This placement of the first grid-concealment ceiling panel 300 and peripheral edge portions 334 locates each of the four outward facing peripheral edge surfaces 301 with peripheral edges 334 at the outermost or far side longitudinal edges 214 of the grid support member bottom flanges 210 surrounding the respective grid opening 208 (with respect to the first ceiling panel 300). The peripheral edges 334 are substantially vertically aligned with the outermost longitudinal edges 214 on all sides of the first ceiling panel 300 (allowing for standard installation tolerances). The four bottom surfaces 204 of the grid support members 202, 204 are thus fully concealed and covered, except for a small remaining triangular-shaped exposed portion of the grid face at each of the four diagonal or chamfered corners 331 of the first ceiling panel 300.

To better describe the exposed triangular-shaped portion of the grid face (i.e. grid support bottom surfaces 206), it should be noted that each corner 331 of the first ceiling panel 300 lies at the intersection of a longitudinal grid support member 202 and two opposed lateral grid support members 204 as shown in FIGS. 5-8. These intersections of longitudinal and lateral grid support members 202, 204 are where the each of the four exposed triangular-shaped exposed portions of the bottom surfaces 206 at the corners 331 of the first ceiling panel 300 are located. This can be readily envisioned with specific reference to FIG. 6 and imagining that only the top left ceiling panel 300 (e.g. first ceiling panel 300) has been yet installed up to this point. It can be seen that an exposed triangular portion of the grid face is formed by chamfered edge surface 305 of the first ceiling panel 300 running from top right down to top left and the two intersecting dashed lines below representing portions of the grid support bottom surfaces 206 at the cruciform intersection of longitudinal and lateral grid support members 202, 204. These exposed triangular-shaped portions of bottom surfaces 206 will be filled when additional grid-concealment ceiling panels 300 are installed, as described below.

With reference now to FIGS. 1, 1A, 2, and 5-8, the method continues with a next step in which a second grid-concealment ceiling panel 300 is next positioned diagonally with respect to the first ceiling panel 300 in a second available grid opening 208. This second grid opening 208 is thus located diagonally adjacent to the first grid opening 208 now occupied by the previously mounted first ceiling panel 300, as discussed above.

The second grid-concealment ceiling panel 300 is mounted in the second grid opening 208. The panel 300 may be attached to the grid support members 202 and 204 surrounding the respective second grid opening 208 in a similar manner to the first grid-concealment ceiling panel 300 in one embodiment. The peripheral edge portions 332 of the second ceiling panel 300 are similarly located or placed beneath and overlap the bottom surfaces 206 (e.g. grid faces) of the grid support members 202 and 204 adjacent the respective second grid opening 208. Accordingly, the peripheral edge portions 332 may cover the bottom surfaces 206 or grid faces on all four sides of the second ceiling panel 300, either completely in a manner which fully conceals the grid faces or partially to intentionally leave a portion of the grid faces exposed and visible from below the ceiling system 100.

In one embodiment, the peripheral edge portions 332 of the second ceiling panel 300 completely cover and conceal the four bottom surfaces 204 or grid faces surrounding the second grid opening 208. This placement of the second grid-concealment ceiling panel 300 and peripheral edge portions 334 locates each of the four outward facing peripheral edge surfaces 301 with peripheral edges 334 at the outermost or far side longitudinal edges 214 of the grid support member bottom flanges 210 surrounding the second grid opening 208 (with respect to the second ceiling panel 300). The peripheral edges 334 are substantially vertically aligned with the outermost longitudinal edges 214 on all sides of the second ceiling panel 300 (allowing for standard installation tolerances). The four bottom surfaces 204 of the grid support members 202, 204 are thus fully concealed and covered.

By mounting the second grid-concealment ceiling panel 300, it should be noted that the small remaining triangular-shaped exposed portion of the grid face described above that lies between diagonally adjacent mating corners of the first and second ceiling panels 300 is now filled by the chamfered corner 331 of the second ceiling panel 300. This is shown for example in FIGS. 5-8 with specific reference to FIG. 6 (the lower right ceiling panel 300 being the second ceiling panel 300 in this embodiment). As shown, the mating chamfered corner surfaces 305 of the first and second ceiling panels 300 may be positioned in very close proximity to each other or be in abutting contact.

Figure 19:
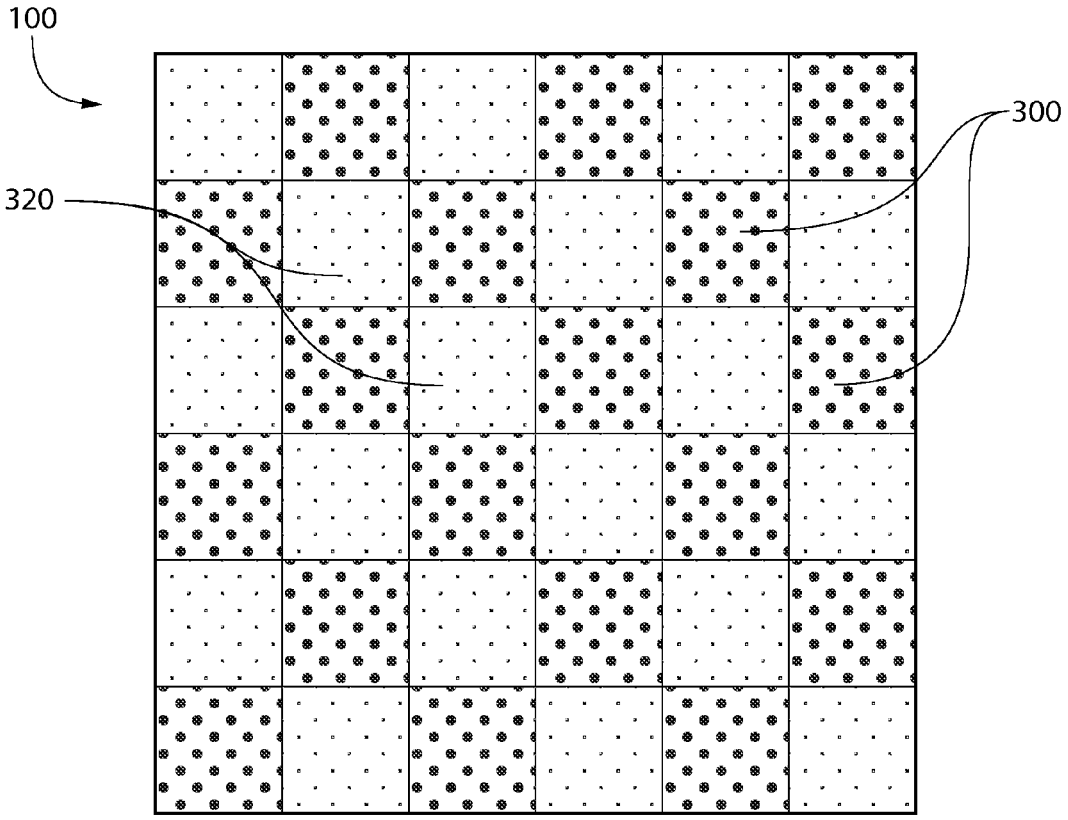
FIG. 19 is a bottom plan view of a completed ceiling system.

The foregoing process may be repeated for mounting additional grid-concealment ceiling panels 300 in a diagonal pattern in the array of grid openings 208. In this manner, the entire grid face (grid support member bottom surfaces 206) may be completely concealed. This process leaves diagonal rows of open or available grid openings 208 in which filler panels 320 may be mounted in a diagonal pattern between diagonal rows of grid-concealment ceiling panels 300 in the manner already disclosed herein. Such as arrangement and completed ceiling system 100 is shown in FIG. 19 (ceiling panels 300 being shown shaded differently than ceiling panels 320 to better show the diagonal patterns and arrays of panels). Accordingly, a checkerboard pattern of ceiling panels 300 and 320 is created in which a ceiling panel 320 is interspersed between pairs of ceiling panels 300 in each horizontal and vertical row of panels. Ceiling panels 300 or 320 of a like kind only contact each or lie in closed proximity at diagonal corners 331 of each type of panel. The bottom visible surfaces 304 and 326 of ceiling panels 300 and 320 respectively may have different visual appearances or textures for a contrasting visual effect that emphasizes the checkerboard pattern or may be the same to form a uniform ceiling appearance.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A ceiling system comprising:

an overhead support grid including a plurality of downward facing grid faces and an array of rectilinear grid openings each configured for mounting a ceiling panel therein, each grid opening surrounded by a pair of longitudinally-extending grid faces and a pair of laterally-extending grid faces surface;

a plurality of grid-concealment ceiling panels disposed in the grid openings, the grid-concealment ceiling panels being arranged diagonally to each other such that a corner of each grid-concealment ceiling panel is disposed proximate to a mating corner of a diagonally adjacent grid-concealment ceiling panel;

wherein the grid-concealment ceiling panels each include peripheral edge portions which extend beneath the grid faces, the peripheral edge portions being configured to at least partially conceal the pair of longitudinally-extending grid faces and the pair of laterally-extending grid faces surrounding the grid opening in which each grid-concealment ceiling panel is disposed;

wherein the peripheral edge portions of the grid-concealment ceiling panels completely conceal the pair of longitudinally-extending grid faces and the pair of laterally-extending grid faces surrounding the grid opening in which each grid-concealment ceiling panel is disposed.

2. The ceiling system of claim 1, wherein the mating corners of the grid-concealment ceiling panels meet at mutually configured angled chamfered corner surfaces formed on the grid-concealment ceiling panels.

3. The ceiling system of claim 2, wherein:

the mating corners completely conceal a cruciform shaped intersection of the longitudinal-extending and laterally-extending grid faces formed at each corner of the grid-concealment ceiling panels; and the peripheral edge portions completely conceal the pair of longitudinally-extending grid faces and the pair of laterally-extending grid faces surrounding the grid opening in which each grid-concealment ceiling panel is disposed.

4. The ceiling system of claim 1, wherein the grid-concealment ceiling panels each have bottom surfaces which all lie in the same horizontal reference plane.

5. The ceiling system of claim 1, wherein the longitudinally-extending grid faces and the laterally-extending grid faces are formed by downward facing horizontal bottom surfaces of the support grid.

6. The ceiling system of claim 5, wherein the support grid is comprised of a plurality of intersecting longitudinal grid support members and lateral grid support members, bottom surfaces being defined by bottom flanges of a longitudinal and lateral grid support members.

7. The ceiling system of claim 6, further comprising four peripheral edges formed by the peripheral edge portions of each grid-concealment ceiling panel, wherein each of the four the peripheral edges are substantially vertically aligned with a longitudinal edge of one of the longitudinal grid support members or a longitudinal edge of one of the lateral grid support members.

8. The ceiling system of claim 1, wherein the grid-concealment ceiling panels are arranged in diagonal rows in the support grid.

9. A ceiling system comprising:

an overhead support grid including a plurality of downward facing grid faces and an array of rectilinear grid openings each configured for mounting a ceiling panel therein, each grid opening surrounded by a pair of longitudinally-extending grid faces and a pair of laterally-extending grid faces surface;

a plurality of grid-concealment ceiling panels disposed in the grid openings, the grid-concealment ceiling panels being arranged diagonally to each other such that a corner of each grid-concealment ceiling panel is disposed proximate to a mating corner of a diagonally adjacent grid-concealment ceiling panel; and a plurality of filler ceiling panels disposed in the grid openings, the grid-concealment ceiling panels being arranged diagonally to each other in the support grid, wherein the filler ceiling panels do not extend beneath the grid faces of the support grid;

wherein the grid-concealment ceiling panels each include peripheral edge portions which extend beneath the grid faces, the peripheral edge portions being configured to at least partially conceal the pair of longitudinally-extending grid faces and the pair of laterally-extending grid faces surrounding the grid opening in which each grid-concealment ceiling panel is disposed.

10. The ceiling system of claim 9, wherein the filler panels include peripheral edges which are arranged in close proximity to peripheral edges of the grid-concealment ceiling panels beneath the grid faces.

11. A ceiling system comprising:

an overhead support grid configured for mounting ceiling panels, the support grid comprising:

(i) a longitudinal axis;

(ii) a plurality of longitudinal grid support members arranged parallel to the longitudinal axis, the longitudinal grid support members including a flange having a downward facing bottom surface; and (iii) a plurality of lateral grid support members arranged transversely between pairs of longitudinal grid support members, the lateral grid support members each having a flange defining a downward facing bottom surface, the longitudinal and lateral grid support members forming an array of rectilinear grid openings;

a plurality of grid-concealment ceiling panels mounted in the grid openings, the grid-concealment ceiling panels each including a chamfered corner, each grid-concealment ceiling panel being arranged to meet one other grid-concealment ceiling panel disposed diagonally adjacent thereto at the chamfered corners of the grid-concealment ceiling panels;

wherein the grid-concealment ceiling panels each include peripheral edge portions which completely conceal a pair of longitudinally-extending bottom surfaces and a pair of laterally-extending bottom surfaces surrounding the grid opening in which each grid-concealment ceiling panel is disposed.

12. The ceiling system of claim 11, further comprising a filler ceiling panel mounted in a grid opening laterally or longitudinally adjacent to one grid-concealment ceiling panel, the filler ceiling panel including a peripheral edge which proximately meets a peripheral edge formed by the peripheral edge portion of the one grid-concealment ceiling panel beneath one of the bottom surfaces of the support grid.

13. The ceiling system of claim 12, wherein the peripheral edge portion of the one grid-concealment ceiling panel completely overlays the one bottom surface of the support grid to completely conceal the one bottom surface.

14. The ceiling system of claim 11, further comprising a plurality of filler ceiling panels mounted in the support grid, the plurality of filler ceiling panels being arranged in diagonal rows disposed between diagonal rows of grid-concealment ceiling panels.

15. The ceiling system of claim 14, wherein the filler ceiling panels do not extend beneath a pair of longitudinally-extending bottom surfaces and a pair of laterally-extending bottom surfaces surrounding the grid opening in which each filler ceiling panel is disposed.

* * * * *